United States Patent [19]

Ogasawara et al.

[11] Patent Number: 4,917,022

[45] Date of Patent: Apr. 17, 1990

[54] SAFE HAVING MOTOR-DRIVEN LOCKING MECHANISM

[75] Inventors: Toshitaka Ogasawara; Kouichi Kasai, both of Saitama, Japan

[73] Assignee: Olympic Co., Ltd., Saitama, Japan

[21] Appl. No.: 285,049

[22] Filed: Dec. 15, 1988

[30] Foreign Application Priority Data

Sep. 29, 1988 [JP] Japan ..... 63-246087

[51] Int. Cl.[4] ..... G08B 13/08; E05G 1/04; E05B 49/00

[52] U.S. Cl. ..... 109/43; 109/59 T; 70/278

[58] Field of Search ..... 109/43, 59 R, 59 T; 70/277, 278, 279, 280, 282; 340/825.31, 825.56

[56] References Cited

U.S. PATENT DOCUMENTS

| | | | |
|---|---|---|---|
| 3,733,861 | 5/1973 | Lester | 70/278 |
| 3,735,714 | 5/1973 | Shoop | 109/59 R |
| 4,148,092 | 4/1979 | Martin | 70/278 |
| 4,686,912 | 8/1987 | Fogleman et al. | 109/59 T |
| 4,744,021 | 5/1988 | Kristy | 70/278 |

*Primary Examiner*—Neill R. Wilson
*Attorney, Agent, or Firm*—Koda & Androlia

[57] ABSTRACT

A safe of the present invention is easily locked or unlocked by the rotational force of a drive motor in accordance with a signal input from the outside of the safe. A locking mechanism is provided within the door. A lock bar is provided with a lock bolt on one end thereof which protrudes from the door and effects locking engagement between the door and the safe body. At ordinary time, the lock bolt is urged to the locking engagement. The drive motor is controlled by a control circuit which receives a safe open/close command signal from the outside. A driving means is revolved by the drive motor and when it engages a drive arm provided on the lock bar, the driving means moves the lock bar against the urging force, thereby releasing the locking engagement of the lock bar. Since secure locking/unlocking operation of the safe is performed by driving the drive motor only to move the lock bar in the direction in which the lock bar is against the urging force, it is possible to simplify the structure of the safe having a motor-driven locking mechanism.

8 Claims, 19 Drawing Sheets

| FIG.13A | FIG.13B |
|---|---|

| FIG.14A | FIG.14B |
|---|---|

| FIG.16A | FIG.16B |
|---|---|

LCD DISPLAYS "ERROR", ERROR ALARM IS RUNG FOR 2 SEC, 1 IS ADDED TO ERROR COUNT
302
303
ERROR COUNT IS 4 ?
YES
NO
LCD DISPLAYS "RECODE", OPEN KEY LED IS OFF
304
E
D
271
ERROR TIMER IS SET
272
LCD IS CLEARED, BACK LIGHT IS OFF, LEDS ARE OFF, 10-MIN TIMER IS SET
273
ON/C KEY IS ON ?
YES
INITIAL OPERATION
NO
274
TIME IS OVER ?
NO
YES
275
ERROR COUNT IS CLEARED
END

SAFE HAVING MOTOR-DRIVEN LOCKING MECHANISM

BACKGROUND OF THE INVENTION

1. Field of the Invention

The present invention relates to a safe having a motor-driven locking mechanism and, more particularly, to a safe having a motor-driven locking mechanism by which the door is locked or unlocked easily and reliably by the rotational force of a drive motor rotating in accordance with the input of an open/close command signal.

2. Description of the Prior Art

Safes are used in various places for the purpose of keeping money, valuables and important papers. Particularly, hotels and the like require a safe for each room which is easily locked or unlocked by the guest.

A conventional personal safe of this kind for hotels adopts the structure in which the door is locked or unlocked by turning the key. Such a key-operated safe, however, is troublesome because the user must keep the key every time. In addition, since such a safe is comparatively easy to unlock, it involves a danger of being robbed.

Personal safes having a motor-driven locking mechanism have recently been put to practical use. This kind of safe is advantageous in that since the drive motor for locking/unlocking the door is controlled by the open/-close command signal followed by an appropriate password, there is little possibility of being robbed.

If the command signal for the drive motor is supplied by the input of the registered number by means of a keyboard or the like, the hotel guest or the like need not always take the safe key with him. Due to these conveniences, safes having a motor-driven locking mechanism gain public favor.

Such a conventional safe having a motor-driven locking mechanism, however, has some problems. For example, it is comparatively difficult to appropriately combine the motor for driving locking mechanism by an electrical command signal with a lock bolt having an adequate mechanical rigidity and used for locking/unlocking the door, which fact often causes a mechanical trouble in the safe.

Conventionally, when the lock bolt is directly driven by the motor, the main shaft of the motor and the lock bolt are generally directly connected by an eccentric cam or the like, so that the distance of travel of the lock bolt is controlled by the amount of rotation of the motor either by using the rotation of the motor itself or converting it into the linear movement. It is therefore often the case that the rotation of the motor is not transmitted accurately due to the grating of the lock bolt or the like.

In addition, since the amount of rotation of the motor directly determines the distance of travel of the lock bolt, it is necessary to control the rotation of the motor with accuracy, and a large-sized motor having a large driving torque and high capacity of controlling the amount of rotation is required, thereby inconveniently increasing the size of the locking mechanism.

SUMMARY OF THE INVENTION

Accordingly, it is an object of the present invention to eliminate the above-described problems in the prior art and to provide a safe having an improved motor-driven locking mechanism which is capable of reliably locking/unlocking the door with the lock bolt by a small-sized and light weight drive motor and which dispenses with the need for such a strict adjustment of the accuracy of the parts or the assembling accuracy of the motor and the locking mechanism as in the prior art.

To achieve this aim, the present invention provides a safe having a motor-driven locking mechanism comprising; a lock bar which is slidably provided within a door; a lock bolt which is provided on one end of the lock bar in such a manner as to protrude from the door and effect locking engagement between the door and the safe body; an urging means for urging the lock bar to the CLOSE position at which the lock bolt protruding from the door is lockable into the safe body; a driving member which is engageable with a drive arm provided on the lock bar in such a manner that when the driving member is revolved and comes into contact with the drive arm, the driving member engages the drive arm and, against the urging force of the urging means, moves the lock bar to the OPEN position at which the lock bolt is drawn into the door to release the locking engagement and, when the driving means reaches a position at which the driving member is released from the drive arm, the driving means restores the lock bar to the CLOSE position by the urging force of the urging means; a drive motor for revolving the driving member to the position at which the driving member engages the drive arm and to the position at which the driving member is released from the drive arm; a lock bar detector for detecting the OPEN position and the CLOSE position of the lock bar; and a control circuit for receiving a detection signal of the lock bar detector and a safe open/close command signal supplied from the outside of the safe and supplying the desired drive signal to the drive motor.

The locking mechanism having the above-described structure in accordance with the present invention is advantageous in that since the drive motor and the lock bolt or the lock bar are not constantly in engagement but they are engaged with each other only when the lock bar is moved to the OPEN position for unlocking the safe and when the driving member is released from the drive arm of the lock bar in order to set the OPEN position of the lock bar free at the time of locking, the drive motor has only to transmit the driving force in one direction in which the lock bar is pushed by the driving member, thereby enabling the safe to be reliably locked/ unlocked by a simple structure dispensing with the need for the mechanical positional or other accuracies between the drive motor and the lock bolt.

The above and other objects, features and advantages of the present invention will become clear from the following description of the preferred embodiment thereof, taken in conjunction with the accompanying drawings.

DESCRIPTION OF THE PREFERRED EMBODIMENT

The preferred embodiment of the present invention will be explained with reference to the accompanying drawings.

Figure 2:
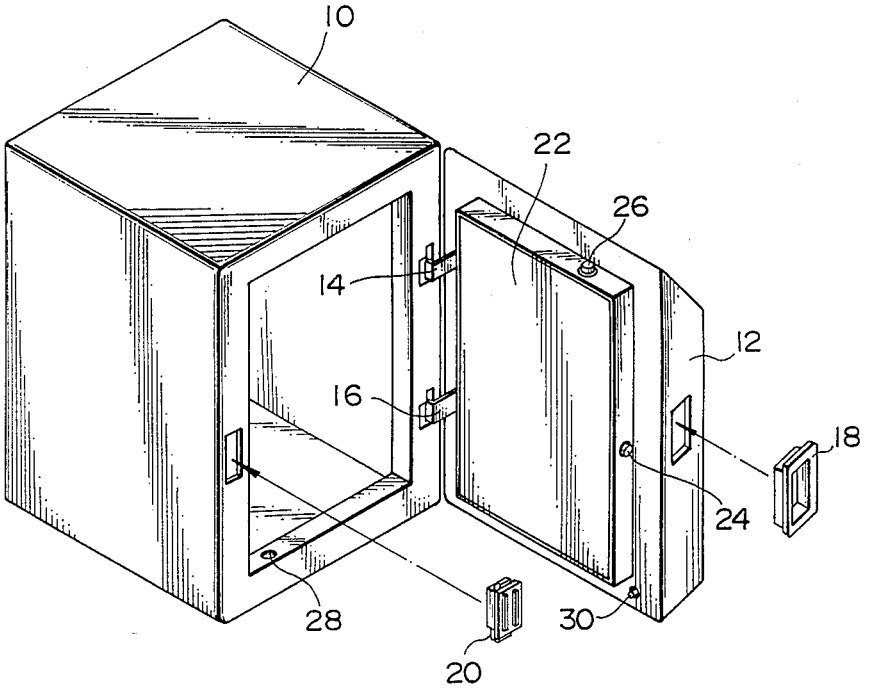
FIG. 2 is a perspective view of the embodiment shown in FIG. 1 in the open state.

Referring first to FIG. 2 which schematically shows a safe having a motor-driven locking mechanism according to the present invention, a safe body 10 is provided with a door 12 supported by hinges 14, 16 in such a manner as to be freely opened and closed, as is well known.

The door 12 is provided with a handle 18 with which the user manually opens or closes the door 12. A magnet latch 20 is provided on the front surface of the safe body 10 so that the CLOSE position is securely retained by the magnet latch 20 while the door 12 is closed. Such positioning by a magnetic force is suitable especially for retaining the secure relative position between the safe body 10 and the door 12 when a lock bolt is pushed or drawn by the motor, thereby preventing the lock bolt from grating.

The locking mechanism for effecting or releasing the locking engagement between the door 12 and the safe body 10 is provided within the door 12. The locking mechanism is concealed by a cover 22 in FIG. 2.

Figure 1:
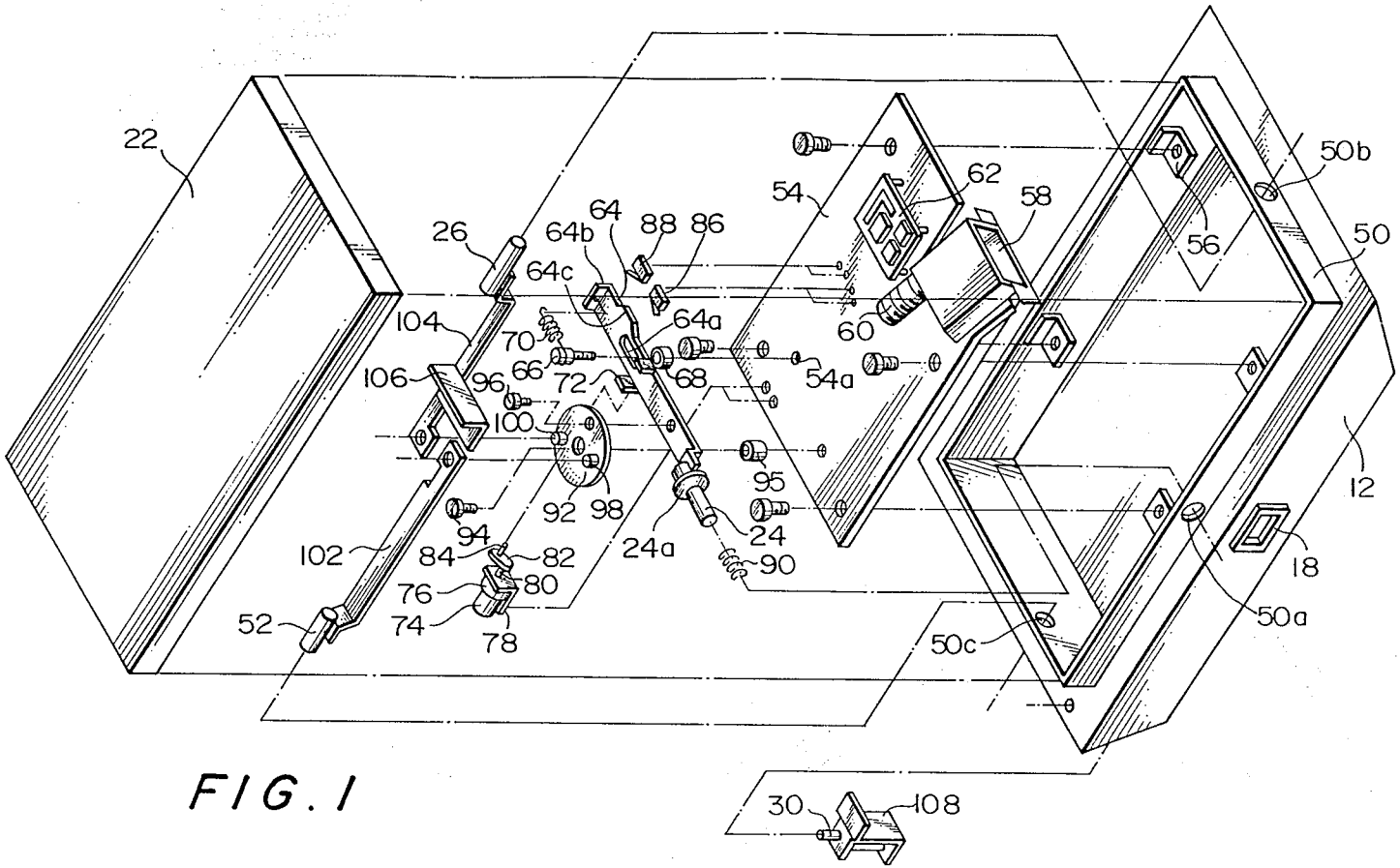
FIG. 1 is an exploded perspective view of the door with a built-in locking mechanism of a preferred embodiment of a safe having a motor-driven locking mechanism according to the present invention.

Although only a lock bolt 24 on the side surface and a lock bolt 26 on the upper surface are shown in FIG. 2, another lock bolt represented by the reference numeral 52 in FIG. 1 is provided on the lower surface and the door 12 is locked from the three directions in this embodiment, as will be described later.

It goes without saying that holes for receiving the respective lock bolts are provided on the safe body 10 in correspondence with the respective lock bolts, but only a lock hole 28 is shown in FIG. 2.

In this way, it is easy to lock/unlock the safe in accordance with a command signal from the outside by pushing or drawing each lock bolt from or into the door 12 while being controlled b a drive motor.

In this embodiment, a door switch 30 is provided on the door 12, and when the safe body 10 is secure closed, the door switch 30 outputs a signal indicating the detection of the CLOSE position of the door 12.

Figure 3:
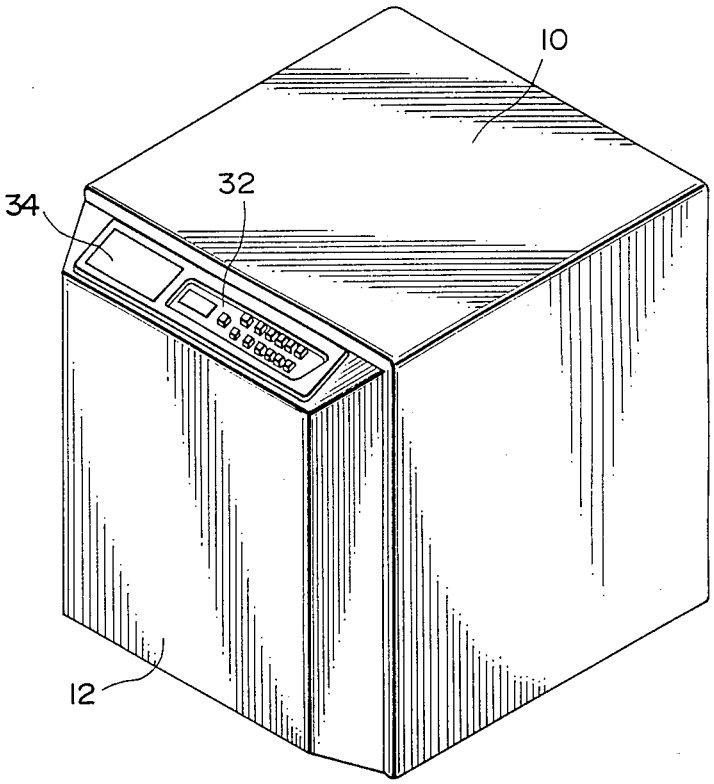
FIG. 3 is a perspective view of the embodiment shown in FIG. 1 in the closed state.

FIG. 3 schematically shows the outside of the door in the closed state. On the upper surface of the door 12, an operation indicator 32 and an emergency device 34 are provided.

The operation indicator 32 includes a keyboard for inputting an open/close command signal etc. and a display portion for displaying the operational state. The details are shown in FIG. 4.

Figure 4:
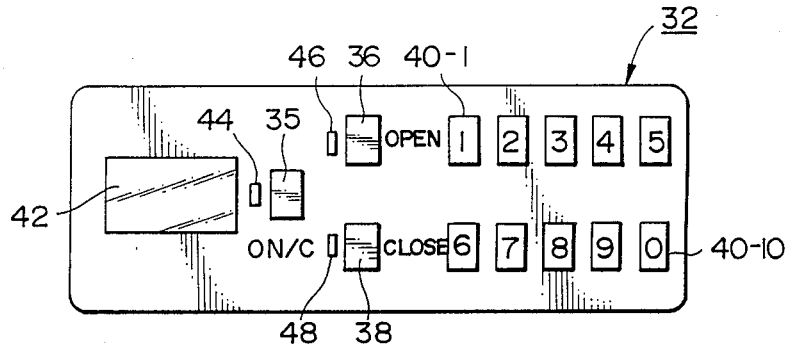
FIG. 4 is an enlarged explanatory view of the operation indicator on the door shown in FIG. 3.

In FIG. 4, the operation indicator 32 includes a power source clear key 35, an OPEN key 36, a CLOSE key 38 and ten code keys 40-1 to 40-10. By pressing some of these keys, a predetermined command is input.

The display portion of the operation indicator 32 includes an LCD 42 for displaying necessary signs or pictorial symbols by liquid crystal, LED displays 45, 46 and 48 provided in correspondence with the clear key 35, the OPEN key 36 and the CLOSE key 38, respectively, and a back light for the entire control indicator 32, thereby enabling each operated state to be displayed and the subsequent operation to be guided.

In FIG. 3, a battery is accommodated in the emergency device 34 and a cover is ordinarily secured thereto. In an emergency, however, for example, when the user forgets the registered code, the user can remove the cover and open the door 12 by mechanically operating the locking mechanism from the outside with a master key.

Structure of locking mechanism

The structure of the locking mechanism provided within the door 12 will be explained in detail hereinunder with reference mainly to FIG. 1.

Referring to FIG. 1, the door 12 includes a frame body 50 which can be closed by the cover 22. The locking mechanism is provided inside the door and in the interior surrounded by the frame body 50. The lock bolts 24, 26 and 52 are protruded outwardly from or drawn into holes 50*a*, 50*b* and 50*c*, respectively, which are provided on the side surface, upper surface and lower surface, respectively, of the frame body 50, thereby locking/unlocking the safe body 10.

Although the three lock bolts are provided in this embodiment, the safe of the present invention may be sufficed with only one lock bolt. In this case, the lock bolt 24 provided toward the side surface of the frame body 50 is preferably used.

A lock base board 54 is firmly secured to the interior of the frame body 50. In this embodiment, the lock base board 54 is screwed to four metal fittings 56 provided in the interior of frame body 50.

In the upper portion of the lock base board 54, an emergency chamber 58 which communicates with the emergency device 34 shown in FIG. 3 is provided. An unlocking cylinder 60 which will be described later is connected to the lower portion of the emergency chamber 58.

The lock base board 54 is provided with a control circuit base board 62. A control circuit for receiving a command input from the outside and a detection signal from each switch and supplying the desired drive signal to a drive motor which will be described later is provided on the control circuit base board 62.

The lock bolt 24 is fixed to one end of a lock bar 64. The lock bar 24 is provided with a support shaft 66 which passes through a slot 64*a* and is screwed into a shaft hole 54 on the lock base board 54, whereby the lock bar 64 itself is slidably supported by the lock base board 54 through the support shaft 66.

Figure 5:
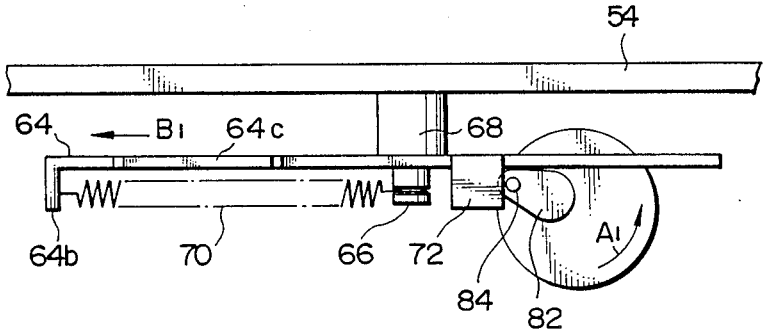
FIG. 5 is a plan view of the main part of the locking mechanism shown in FIG. 1, showing the relationship between the motor and the lock bar in the state of the door being unlocked.
Figure 6:
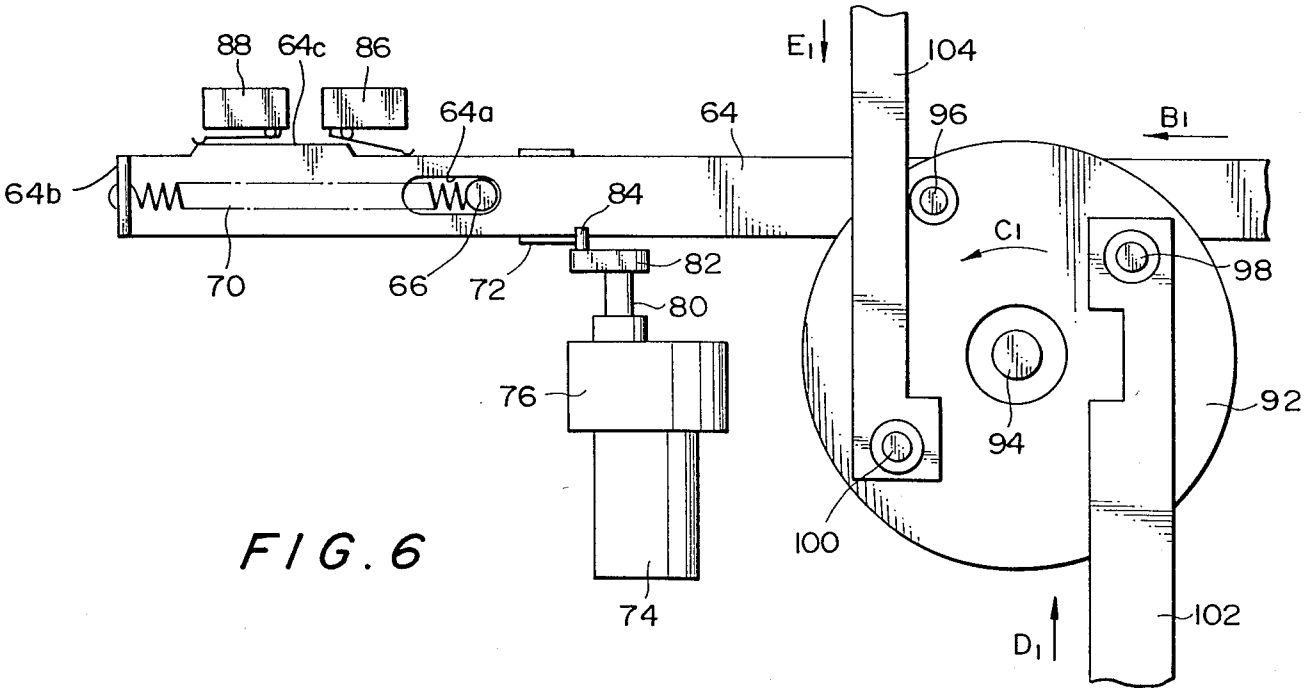
FIG. 6 is an elevational view of the main part of the locking mechanism shown in FIG. 1, showing the relationship between the motor and the lock bar in the state of the door being unlocked as in FIG. 5.

In order to keep the lock bar 64 apart from the lock base board 54 by a predetermined distance, a spacer 68 is provided. FIG. 5 shows in detail the relationship between the lock bar 64 and the lock base board 54 in the assembled state, and FIG. 6 is an elevational of the lock bar 64 shown in FIG. 5.

In this way, the lock bolt 24 moves in the transverse direction by a predetermined length together with the lock bar 64 by virtue of the slot 64*a*, thereby reaching the locking/unlocking position.

At the other end of the lock bar 64 a spring hook 64*b* is provided. An urging spring 70 is hung between the support shaft 66 and the spring hook 64*b* and constantly urged in the righthand direction with respect to the lock bar 64 and the lock bolt 24. In other words, the urging force for protruding the lock bolt 24 outwardly from the hole 50*a* for the locking operation is constantly applied. It will therefore be understood that the lock bar 64 constantly imposes the locking operation on the lock bolt 24 in an ordinary state.

In order to draw the lock bolt 24 within the door 12 against the urging force of the lock bar 64 and producing an unlocked state, a drive motor is used in the present invention. The driving force of a drive motor 74 is transmitted to a drive arm 72 provided on the lock bar 64 through a driving member. In this embodiment, the drive arm 72 is constituted by the bent portion integrally formed with the lock bar 64.

The drive motor 74 is firmly secured to a fitting metal 78 together with a reduction device 76. At the output shaft 80 of the drive motor 74 and the reduction device 76, a drive pin 84 is provided as the driving member through an eccentric cam 82.

The drive pin 84 is revolved by the rotation of the drive motor 74. As will be described later, it is possible that the drive pin 84 pushes away the drive arm 72 and moves the lock bar 64 in the lefthand direction in the drawing against the urging force of the urging spring 70 so as to draw the lock bolt 24 within the door 12, thereby opening it. It is also possible to revolve the drive pin 84 to the position at which the drive pin 84 is released from the drive arm 72, and move the lock bar 64 in the righthand direction by the urging force of the urging spring 70, thereby closing the door 12.

In the present invention, since the drive pin 84, which is the driving member of the drive motor 74, is engaged with the drive arm 72 in order to push away the drive arm 72 of the lock bar 64 only in one direction, it is possible to maintain a comparatively loose relationship between the drive pin 84 and the drive arm 72, thereby advantageously dispensing with the strict examination of the structure of each part and the characteristics of the motor.

A lock bar detector for detecting the CLOSE position and the OPEN position of the lock bar 64 is provided in the present invention. In this embodiment, the lock bar detector is composed of a locking switch 86 for detecting the CLOSE position of the lock bar 64 and an unlocking switch 88 for detecting the OPEN position of the lock bar 64, both of them being microswitches firmly screwed to the lock base board 54.

In order to actuate the switches 86, 88, an angular detection cam 64*c* is provided on the lock bar 64. When the lock bar 64 slides in the longitudinal direction, the detection cam 64*c* controls the switches 86, 88 so as to output the desired detection signal. The outputs of the detection signals 86, 88 are naturally supplied to the control circuit.

As described above, according to the present invention, the lock bar 64 rapidly moves to the locking position of the lock bolt 24 by the urging force of the urging spring 70 when the lock bar 64 is released from the drive pin 84 of the drive motor 74. In this embodiment a spring 90 for shock absorption is inserted between the flange 24*a* of the lock bolt 24 and the frame body 50 in order to prevent the lock bolt 24 from violently moving to the CLOSE position, thereby reducing the noise which may be produced at the time of the locking operation.

It goes without saying that the spring 90 for shock absorption may be replaced by a shock absorber of rubber, flexible plastic or the like.

This embodiment is provided with not only the lock bolt 24 fixed to the lock bar 64 in the transverse direction but also the lock bolts 26, 52 moving in the vertical direction. In order to move the lock bolts 26, 52 in the vertical direction by the lock bar 64, a connection plate 92 is connected to the lock bar 64.

The connection plate 92 is firmly rotatably supported by the lock base board 54 through a screw shaft 94, and a spacer 95 is provided between the lock base board 54 and the connection plate 92. The connection plate 92 and the lock bar 64 are loosely anchored to each other by a connection screw 96, whereby the transverse movement of the lock bar 64 is converted into the movement in the direction of the rotation of the connection plate 92.

Two connection pins 98, 100 are erected on the connection plate 92. Connection bars 102, 104 are provided on the connection pins 98, 100, respectively, such that one end of each of the connection bars 102, 104 is retained thereby. To the other ends of the connection bars 102, 104, the lock bolts 52 and 26 are firmly secured. This structure enables not only the lock bolt 24 to be pushed from or drawn into the door 12 in the transverse direction but also the lock bolts 26, 52 to be pushed from or drawn into the door 12 in the vertical direction when the lock bar 64 is moved in the transverse direction.

In this way, in this embodiment, the driving force of the drive motor 74 locks/unlocks the door 12 by the lock bolts 24, 26 and 52 which are pushed or drawn in three different directions, thereby ensuring the locking operation.

An emergency press plate 106 is fixed midway of the connection bar 104 in such a manner as to face the unlocking cylinder 60, thereby enabling the door 12 to be opened in an emergency.

Figure 7:
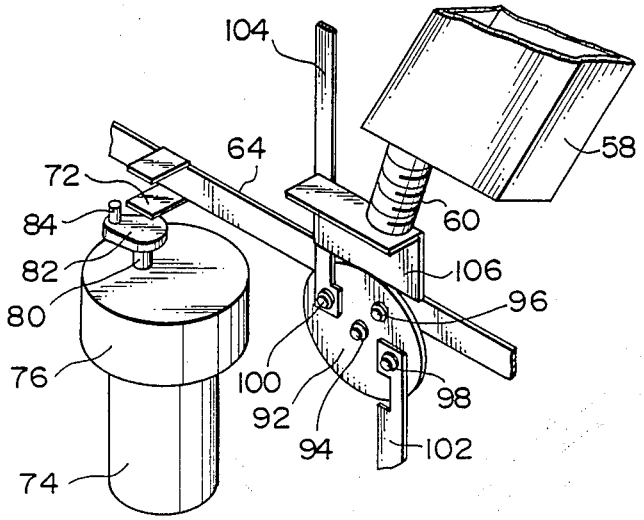
FIG. 7 is a perspective view of the locking mechanism in the state of the door being locked.

FIG. 7 shows the structure of the emergency device 34 in an assembled state. With the lock bar 64 at the CLOSE position, the unlocking cylinder 60 is lowered to the position at which the press plate 106 comes into contact with or close proximity to the lower end of the unlocking cylinder 60. The unlocking cylinder 60 itself constitutes a screw cylinder, and the height thereof is adjustable by adjusting the position at which the unlocking cylinder 60 is screwed into the emergency chamber 58.

Although not shown in detail, the upper end of the unlocking cylinder 60 is a key-operated cover. The key-operated cover can be opened by a predetermined master key. If the press plate 106 is pressed down by an appropriate jig inserted from the top of the thus-opened cylinder 60, it is possible to mechanically rotate the connection plate 92 toward the direction of the OPEN position without driving the motor 74, thereby moving all the lock bolts 24, 26 and 52 to the respective OPEN positions.

In the present invention, since the drive pin 84 of the drive motor 74 is situated at the position at which the drive pin 84 is released from the drive arm 72 of the lock bar 64 in the locked state, the door opening operation in an emergency can be conducted independently of the drive motor 74.

Returning to FIG. 1, the door switch 30 is fixed to a fitting metal 108, through which the door switch 30 is accommodated in the door 12. The switch operator of the door switch 30 protrudes toward the safe body 10 and supplies a closed-door signal to the control circuit when the door 12 is in the correctly closed state, as described above.

Locking/unlocking operation by motor

The locking mechanism in this embodiment has the structure described above. The locking/unlocking operation of the lock bar 64 by the rotation of the motor 74 will now be explained with reference to FIGS. 5 and 6, which show the unlocked state, and FIGS. 8 and 9, which show the locked state.

FIG. 5 shows the state in which the drive pin 84 is rotated by the motor 74 in the direction indicated by the arrow $A_1$ by the motor 74. In this state, the drive pin 84 engages the drive arm 72 and pushes the lock bar 64 in the direction indicated by the arrow $B_1$ against the urging force of the spring 70. The connecting plate 92 then rotates counterclockwise as indicated by the arrow $C_1$ in FIG. 6, and moves the connection bars 102, 104 which are connected to the connection plate 92 in the directions indicated by the arrows $D_1$ and $E_1$, respectively. As a result, the lock bolts 24, 26 and 52 are drawn into the door 12 at the respective OPEN positions.

At the OPEN positions, the unlocking switch 88 simultaneously outputs an unlock signal through the detection cam 64c on the lock bar 64. With the unlock signal, the control circuit supplies a drive stop signal to the drive motor 74. When the motor 74 is stopped, the drive pin 84 is stopped in the state shown in FIGS. 5 and 6, thereby retaining the OPEN positions. Thus, the door 12 can be freely opened or closed in the unlocked state.

Figure 8:
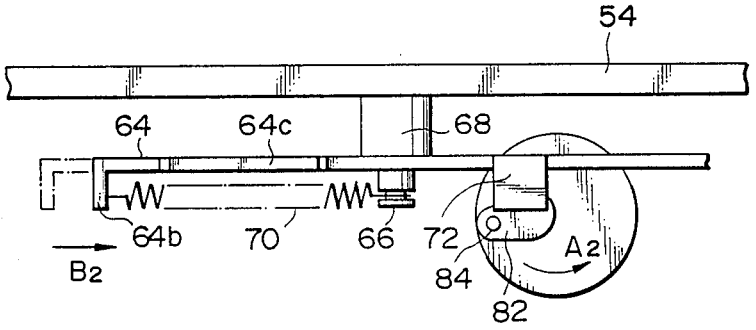
FIGS. 8 and 9 are a plan view and an elevational view, respectively, of the locking mechanism in the state of the door being locked.

In the state shown in FIGS. 5 and 6, when a lock command signal is supplied to the external portion, namely, the operation indicator 32, the drive motor 74 rotates again in the same direction with the unlocking operation, as indicated by the arrow $A_2$. The drive pin 84 then moves to the position at which the drive pin 84 is released from the drive arm 72, as shown in FIG. 8.

Figure 9:
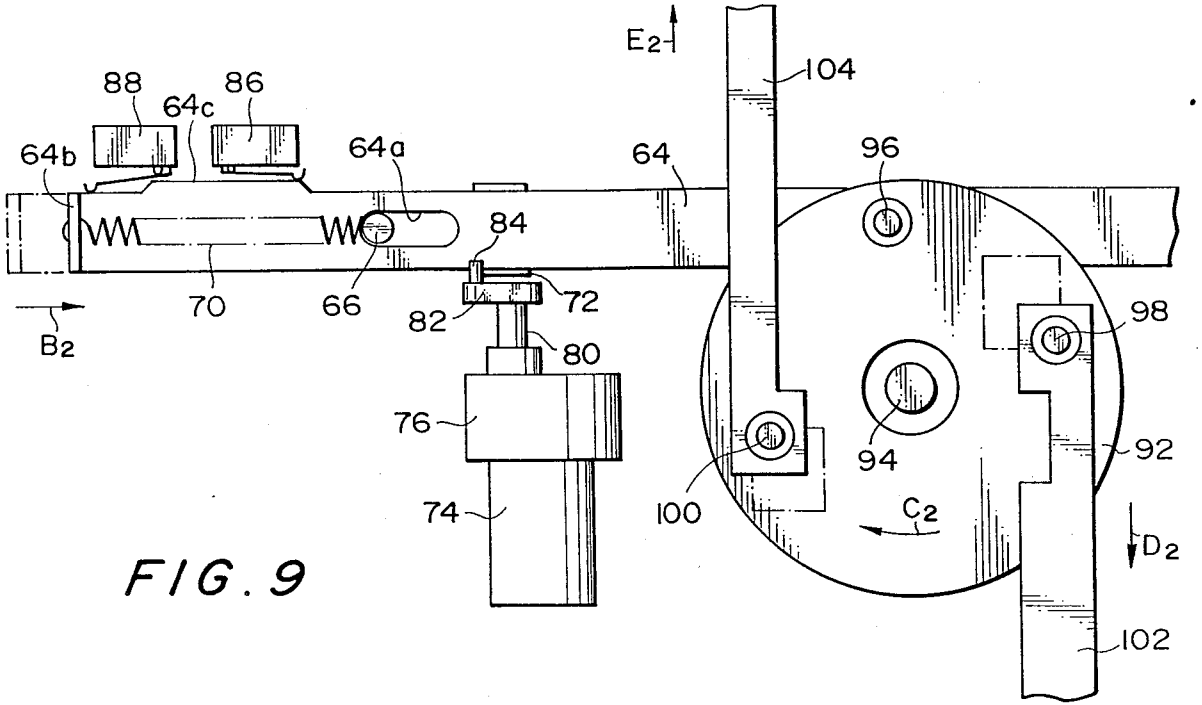

The lock bar 64 consequently moves in the righthand direction as indicated by the arrow $B_2$, thereby rotating the connection plate 92 clockwise as indicated by the arrow $C_2$ in FIG. 9. The connection bars 102, 104 also move in the directions indicated by the arrows $D_2$ and $E_2$, respectively, and, as a result, the lock bolts 24, 26 and 52 are protruded form the door 12, thereby effecting the desired locking engagement between the door 12 and the safe body 10.

Figure 10:
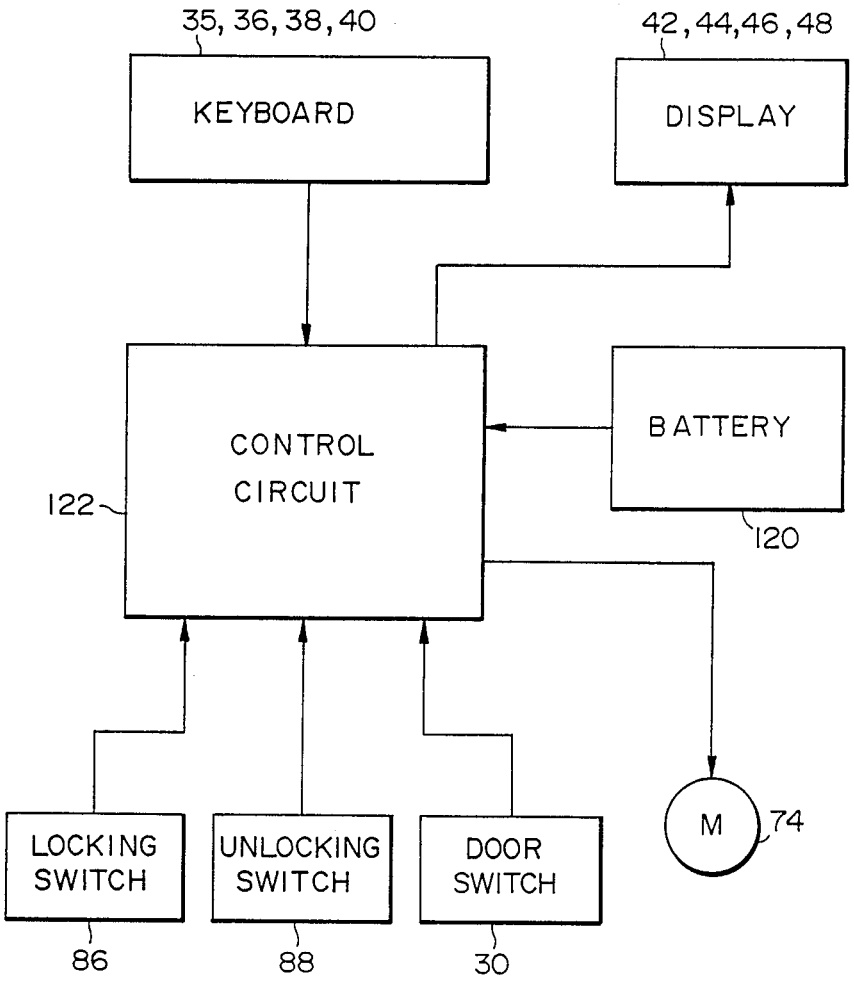
FIG. 10 is a schematic explanatory view of the circuitry of the locking mechanism in accordance with the present invention.

FIG. 10 schematically shows the structure of the motor control circuit in accordance with the present invention. To a control circuit 122 to which a voltage is supplied from a battery 120, detection signals are supplied from the respective switches 30, 86 and 88 and command signals by the user are supplied from the operation keys of the keyboard.

The desired control calculation is carried out from the command signals and the detection signals in the control circuit 122. Each operational state at this time is displayed on the display portion, and a lock/unlock drive signal is supplied to the motor 74.

As described above, according to the present invention, the locking/unlocking operation is facilitated by the unidirectional movement of the driving member by the drive motor, in other words, by moving the driving member in the direction in which the driving member engages the drive arm and pushes it away and the driving member is released from the drive arm.

In the locked state shown in FIGS. 8 and 9, the locking switch 86 outputs a lock signal through the detection cam 60c when the lock bar 64 moves in the direction indicated by the arrow $B_1$, as shown in detail in FIG. 9. With the input of the lock signal, the control circuit 122 stops the rotation of the drive motor 74, and retains the drive pin 84 at the position apart from the drive arm 72, as shown in FIG. 8.

In this state, in order to resume the unlocking operation shown in FIGS. 5 and 6, the driving force for rotating the drive motor 74 in the same direction is applied, thereby revolving again the drive pin 84 as indicated by the arrow $A_1$ so as to push the drive arm 72 in the left-hand direction.

As described above, according to the present invention, it is possible to lock/unlock a safe by a simple structure driven by a motor. In the case of using such a safe having a motor-driven locking mechanism as a personal safe in hotels which is used by many and unspecified persons, it is necessary to add various security systems. The controlling operation of the control circuit in the present invention will be explained hereinunder for each operation.

Initial operation

Figure 11:
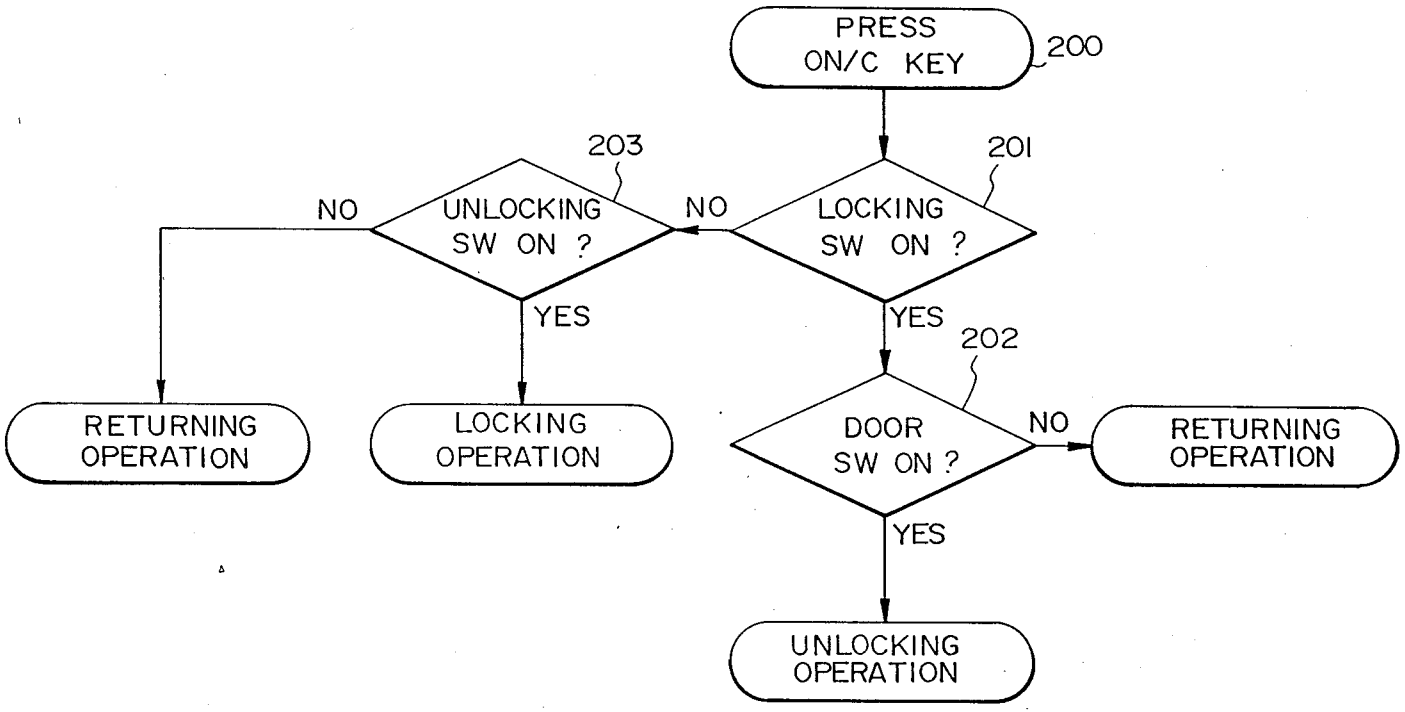
FIG. 11 is a flow chart of the initial operation of the embodiment.

FIG. 11 shows the initial operation of the safe. Normally, the initial operation is completed only by pressing the power source clear key 35 (200).

That is, when the safe is in the locked state, the locking switch 86 is on (201) and the door switch 30 is also on (202). In this state, it is possible to proceed to the ordinary unlocking operation.

On the other hand, when the safe is in the unlocked state, the locking switch 86 is off (201) and the unlocking switch 88 is naturally on (203). In this state, it is possible to proceed to the unlocking operation.

However, if the safe is not in such a normal state, it is necessary to perform the returning operation for restoring the locking mechanism to the initial state. That is, if the door switch 30 is off (202) although the locking mechanism assumes the locked state, in other words, if a lock bolt protrudes while the door 12 is left open, the returning operation is performed for drawing the lock bolt into the door 12. If the locking switch 86 is off (201) and the unlocking switch is also off (203), the lock bar 64 may be considered to be situated midway between the CLOSE position and the OPEN position. In this case, the unlocked state is forcibly produced by the returning operation.

Returning operation

Figure 12:
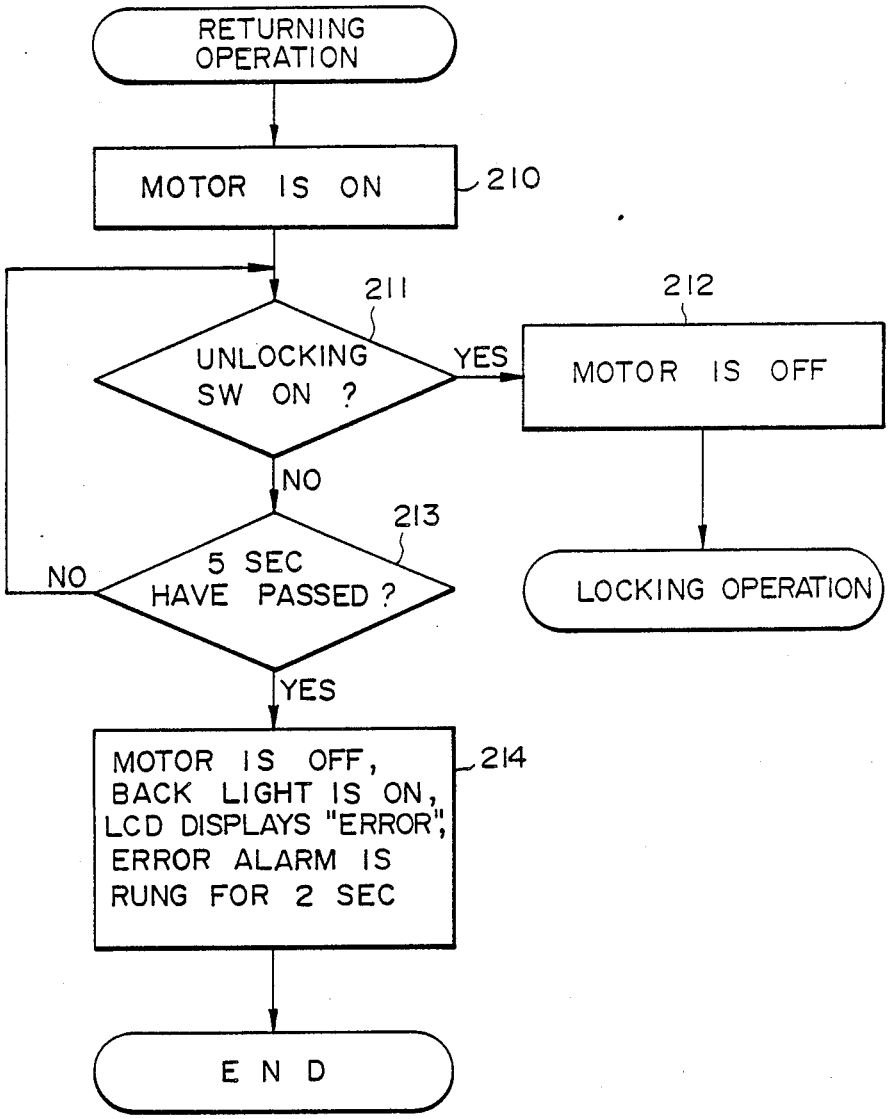
FIG. 12 is a flow chart of the returning operation of the embodiment.

FIG. 12 shows the returning operation for forcibly producing the unlocked state when the abnormality is observed by the initial operation. A drive signal is supplied to the motor 74 (210), and whether the unlocking switch 88 is turned on is ascertained (211). If the unlocking switch 88 is turned on (211), the motor 74 is turned off (212) in preparation for the next locking operation.

On the other hand, if the unlocking switch holds the off state (211), the elapsed time is measured. If the unlock switch 88 still assumes the off state when a preset time of, e.g., 5 seconds has elapsed (213), the motor 73 is turned off and an alarm indicating a trouble in the apparatus is given to the user (214). The alarm in this embodiment includes the display of an error on the LCD 42 and 2-sec ringing of an error alarm.

As described above, if a trouble is produced in the initial operation, the returning operation for unlocking the safe is inevitably performed, and if the returning operation is impossible, an alarm is output.

Locking operation

Figures 13, 13A:
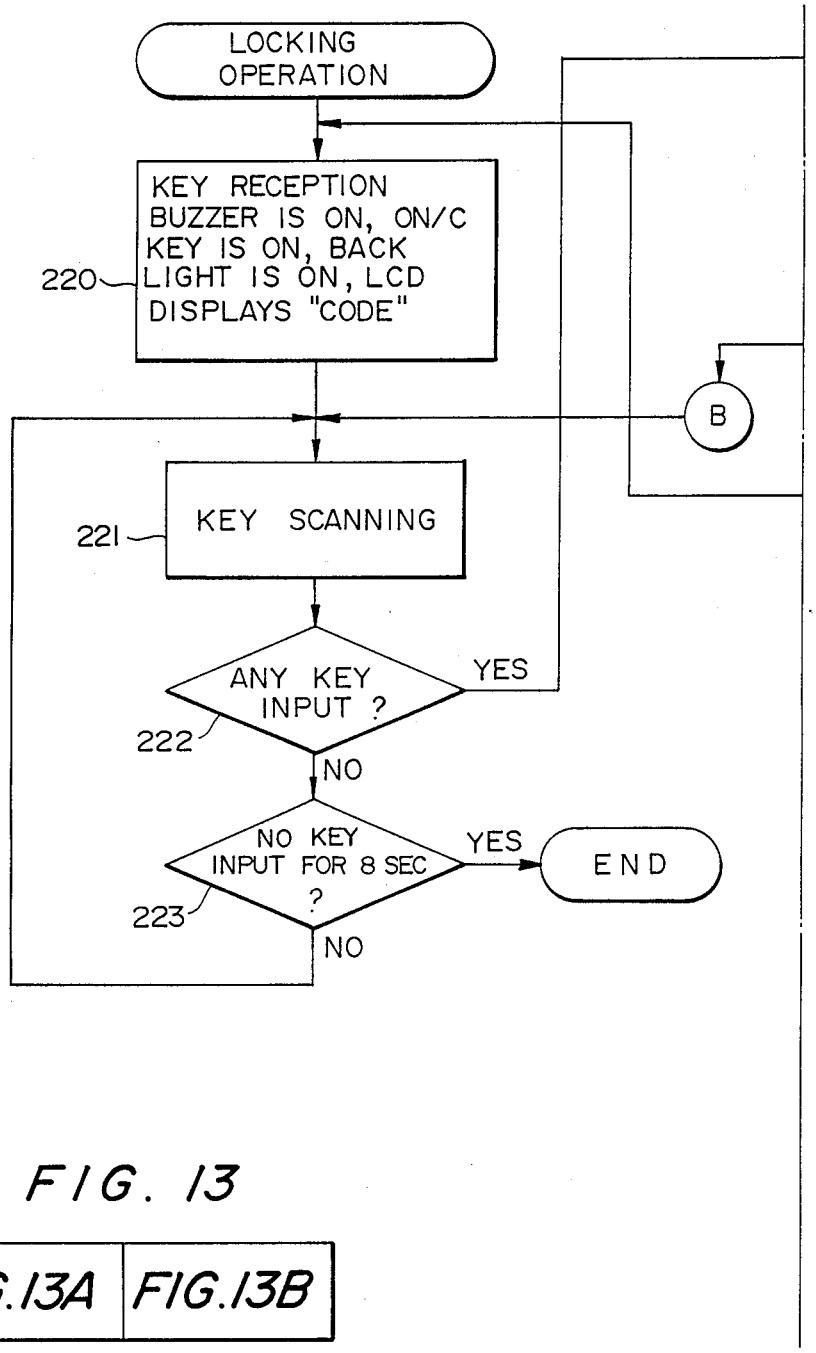
FIGS. 13A and 13B, 14A and 14B and 15 each are flow charts of the locking operation of the embodiment.
Figure 13B:
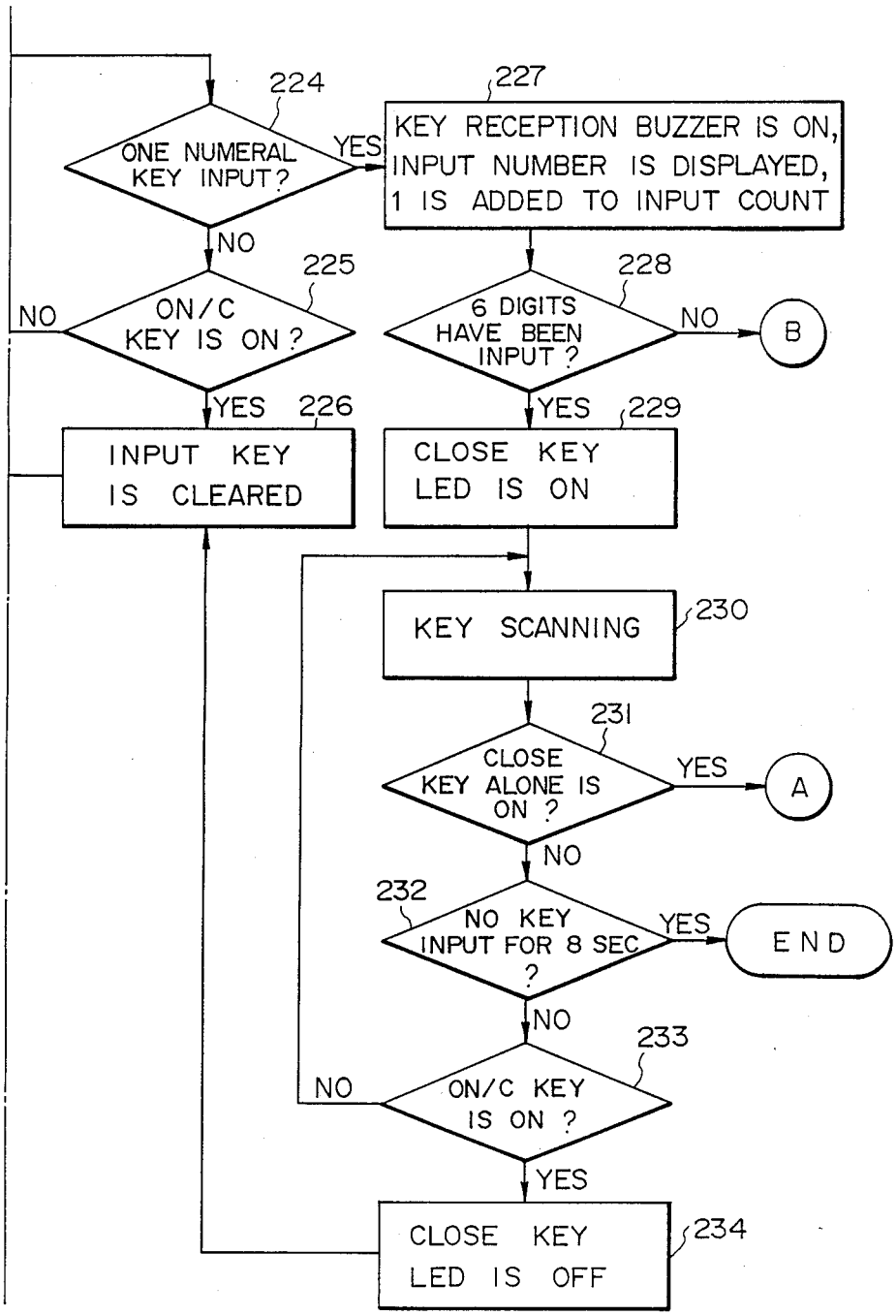
Figures 14, 14A:
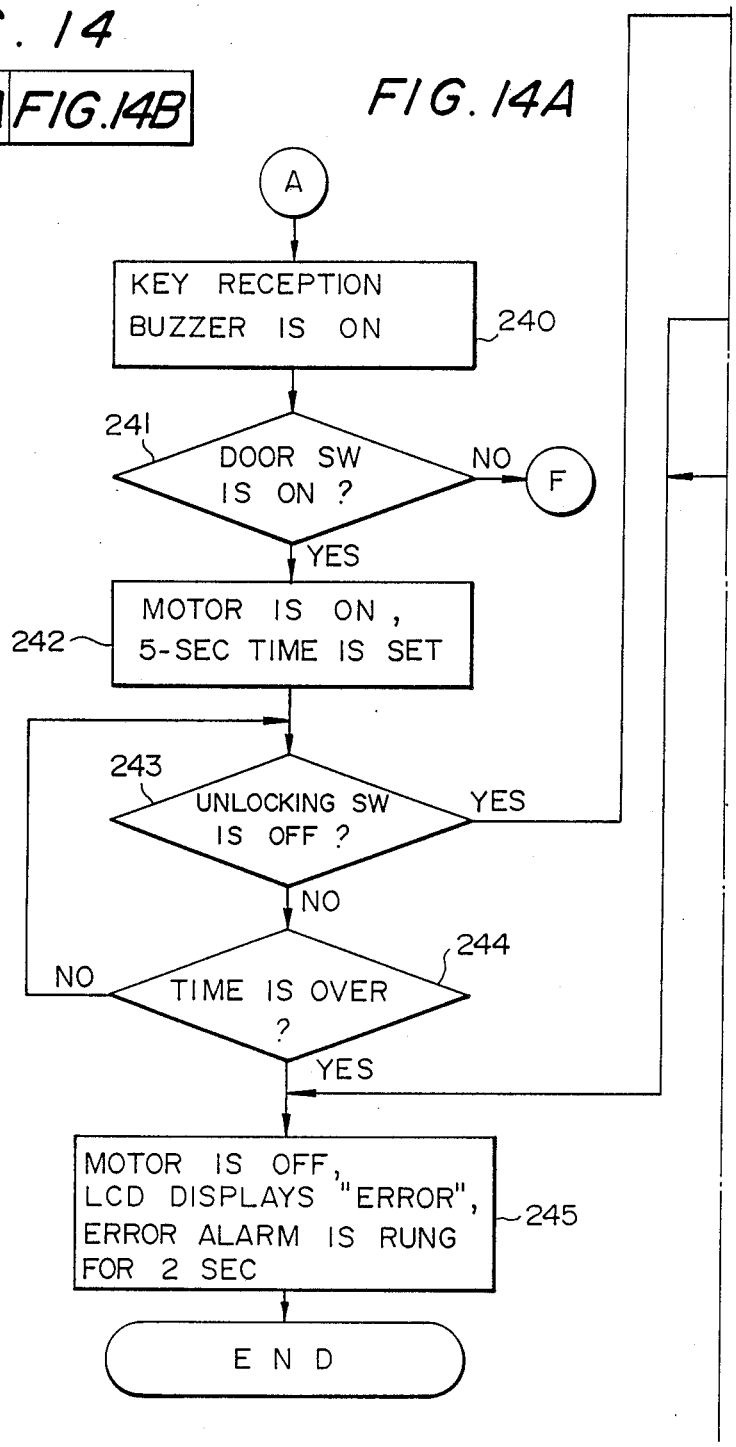
Figure 14B:
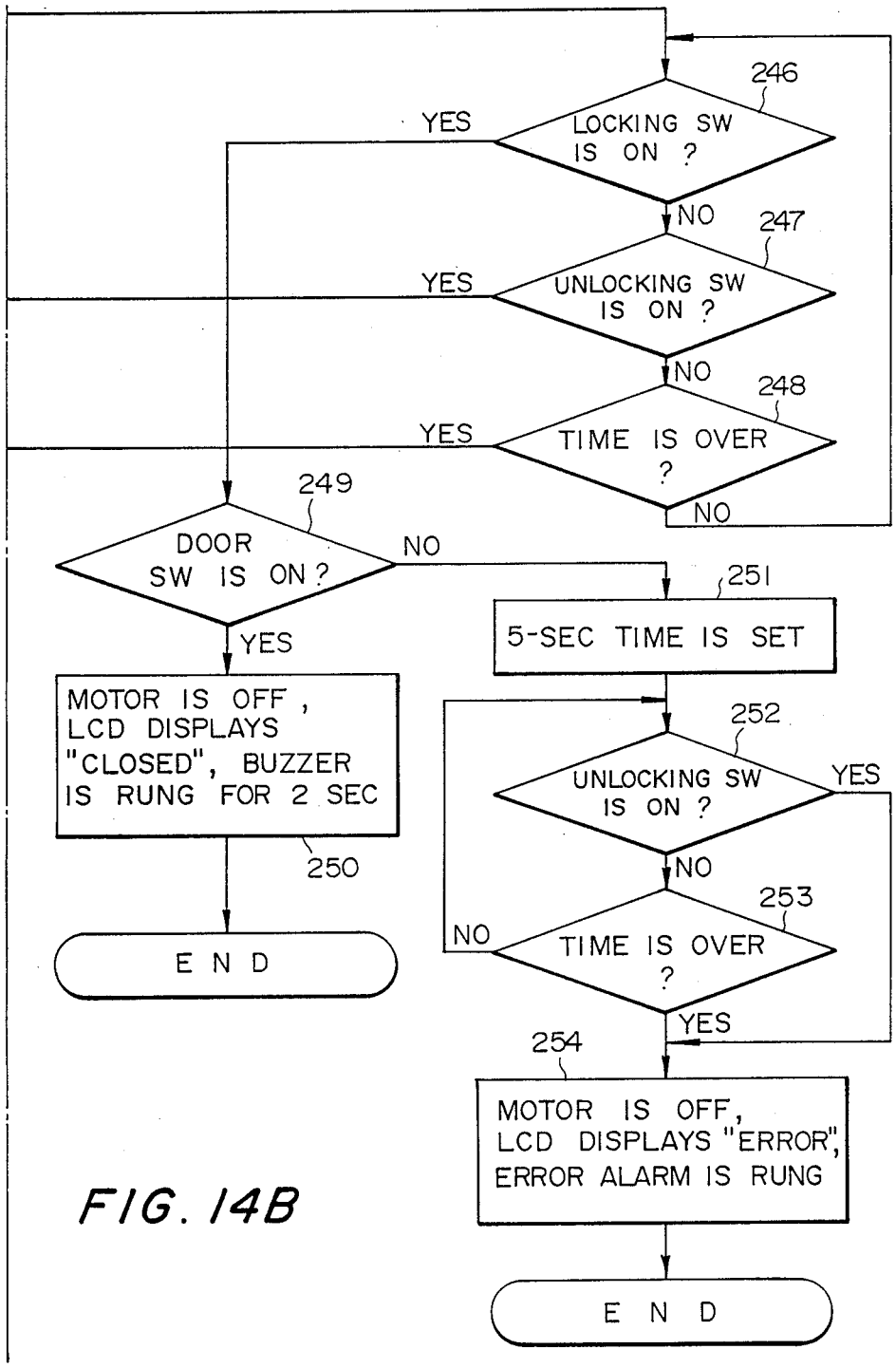
Figure 15:
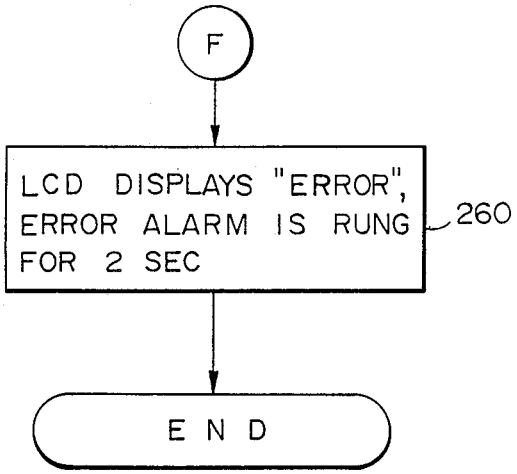

FIGS. 13, 14 and 15 show the locking operation of this embodiment.

When the locking operation is approved by the initial operation shown in FIG. 11, a key reception buzzer produces a sound indicating that the key has been received, the power source clear LED 44 and the back light are turned on, and the LCD 42 displays "CODE" (220) telling the user to input the code. The control circuit 122 judges whether or not there is any key input at the step of key scanning (221), and when there is no key input (222), this state is monitored for 8 seconds (223). If there is no key input for 8 seconds, a series of operation is finished.

Key inputs, namely, the inputs by means of the code keys 40 are subsequently read. When there is a key input, whether only one of the code keys 40 has been operated is ascertained (224). If two code keys or more have been simultaneously operated, and if the power source clear key 35, the OPEN key 36 or the CLOSE key 38 on the operation indicator 32 have been operated, judgment is made as to whether or not the operated key is the power source clear key 35. If the answer is yes, the input key is cleared (226) and the process returns to the step (220). If the answer is no, the process returns to the step of key scanning (221).

The code inputs are received at the step 227 one by one, and every time the code input is received, the key reception buzzer produces sound such as "peep" and the input number is displayed on the LCD 42 and 1 is added to the input count value of an input key counter. This process for key input reception is repeated until the code of a predetermined number of digits, for example, 6 digits in this embodiment is input (228).

When the code of 6 digits has been input, the control circuit 122 stores the registered code in a memory provided therewithin. In other words, the user can set any code of 6 digits for the safe every time the user use the safe. After the code has been set, the user can open or close the safe by using the registered code. The next user can select any new code and set it at the time of locking operation. Thus, the safe of the present invention is very convenient as a personal safe in hotels or the like which will be used by different guests from day to day.

In the above-described way, the control circuit 122 stores the registered code and turns on the CLOSE key LED 48 at the step 229 in preparation for the operation of the CLOSE key 38.

In other words, when the registered code is stored, the control circuit 122 waits for a lock command from the CLOSE key 38.

The control circuit 122 waits for the operation of the CLOSE key 38 for 8 seconds as in the other cases. If there is no input from the CLOSE key 38 even after the elapse of 8 seconds, a series of operation is finished through the steps of key scanning (230), judging whether or not the CLOSE key alone is on (231) and monitoring the operation within the limited seconds (232). If the power source clear key 34 is pressed before the operation of the CLOSE key 38 (233), the CLOSE key LED 48 is turned off (234) and the input key is cleared again (226), whereby the process returns to the step 220.

On the other hand, the operation of the CLOSE key 38 is ordinarily promoted by the lighted LED 48, and when the CLOSE key 38 is pressed, the process proceeds to A shown in FIG. 14.

When the CLOSE key 38 is pressed, the buzzer sounds (240), and whether the door switch 30 is on is ascertained (241). That is, in the locked state, the door 12 must be closed. If the door switch 30 is off, since it indicated that the door 12 is open, "ERROR" is displayed on the LCD 42 at the step 260 in FIG. 15, and the error alarm is rung for 2 seconds to tell the user that the safe 12 is open.

Normally, since the locking operation is performed in the state in which the door 12 is correctly closed, the process proceeds from the step 241 to the step 242 at which the drive motor 74 is driven. This lock command is monitored continuously for a predetermined time, for example, 5 seconds in this embodiment.

For example, when the motor 74 is not driven due to the disconnection or the like of the motor 74 in spite of the supply of the drive command, or when the lock bar 64 does not move in spite of the excitation of the motor 74, the unlocking switch 88 holds the ON state (243), and when a predetermined time, e.g., 5 seconds have passed (244), the control circuit 122 turns off the drive motor 74, displays "ERROR" on the LCD 42 and rings the error alarm for 2 seconds, thereby finishing the operation (245). In this way, the user can know a trouble in the apparatus.

On the other hand, when an ordinary correct control is carried out and an OFF signal is output from the unlocking switch 88, the output of the locking switch 86 is monitored (246). If the locking switch 86 is not turned on after the elapse of a predetermined time, the state of the unlocking switch 88 is monitored (247). If no correct LOCK signal is not received after the elapse of a predetermined time (248), the operation is finished through the alarming operation at the step 245.

If the locking switch 86 is actuated within a predetermined time (246), the state of the door switch 30 is ascertained (249). If the operation is correct, since the door 12 is closed, the door switch 30 output an ON signal. As a result, at the step 250 the motor 74 is turned off, and "CLOSED" is displayed on the LCD 42. In this embodiment, buzzer is sounded for 2 seconds to tell the user that the correct locking operation has been completed.

On the other hand, if the door switch 30 is not on at the step 249, the timer is set for a predetermined time, e.g., 5 seconds (251), and the state of the unlocking switch 88 is ascertained (252). The ascertaining operation is continued for the predetermined time (253), and at the step 254 for alarming operation, the motor 74 is turned off, "ERROR" is displayed on the LCD 42 and the error alarm is rung.

In the above-described way, the locking operation of the safe is completed. If some trouble is produced at any step, the motor 74 is inevitably turned off and an alarm is supplied to the user.

Unlocking operation

The unlocking operation in this embodiment will now be explained with reference to FIGS. 16 and 17.

Figures 16, 16A:
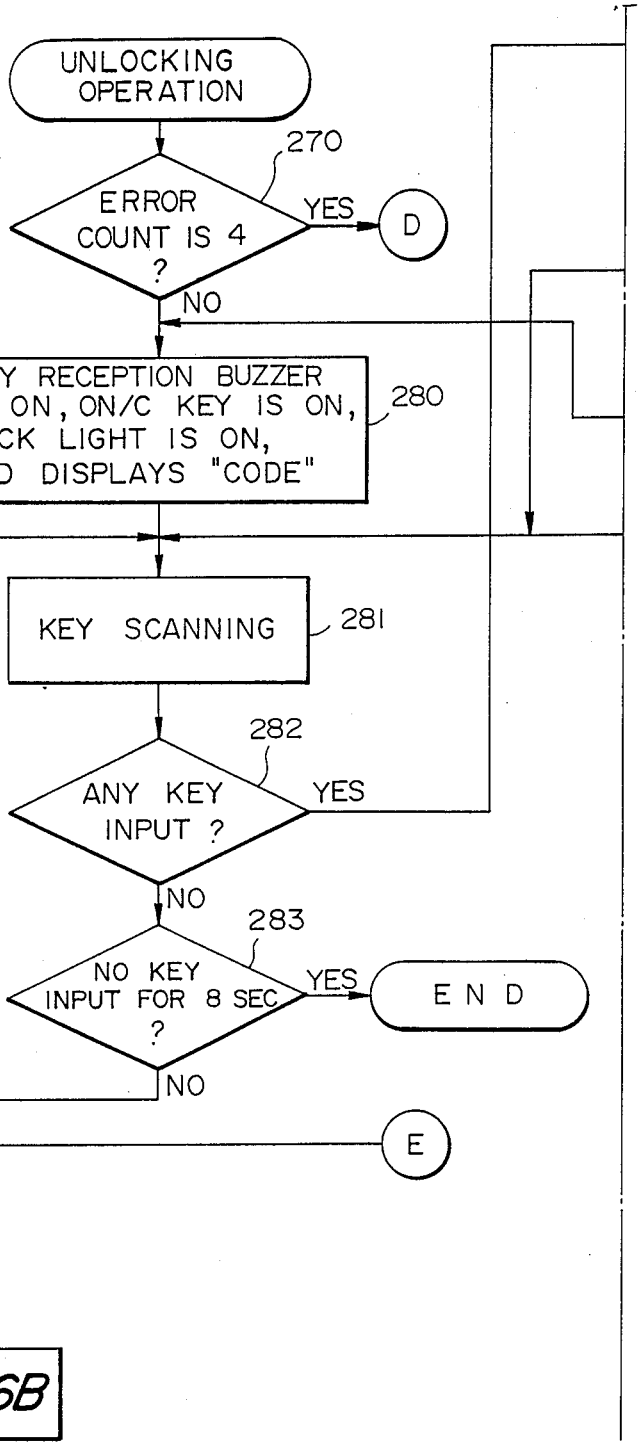
FIGS. 16A and 16B and 17A and 17B are flow charts of the unlocking operation of the embodiment.
Figure 16B:
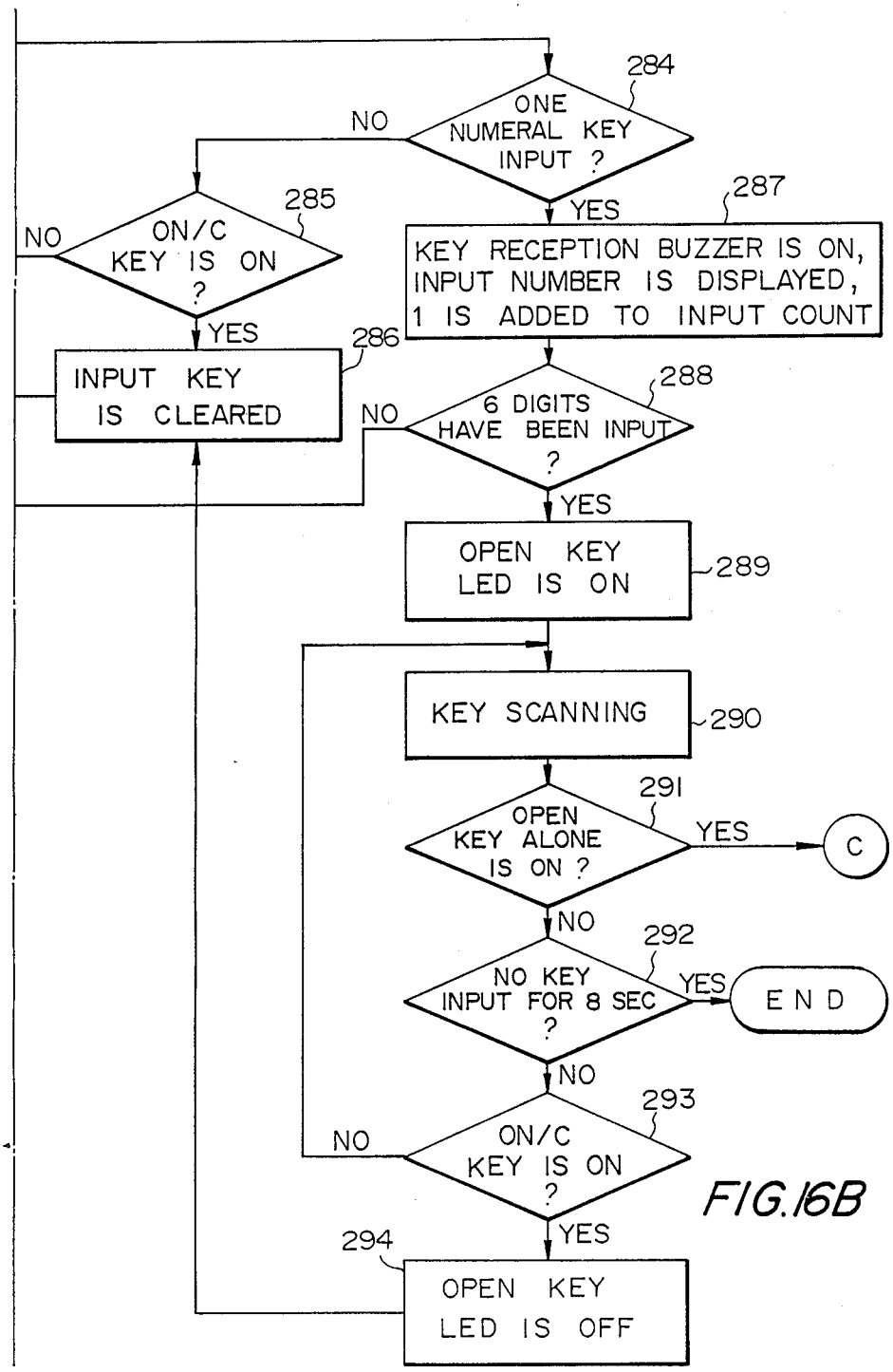

In FIG. 16, when the initial operation shown in FIG. 11 has been completed and the unlocking operation is commanded, judgement is made as to whether or not the error count value is a predetermined number, e.g., 4 in this embodiment at the step 270.

More specifically, in this embodiment, the safe is not unlocked until the current user inputs the code set at the time of the locking operation. The registered code can be input only a predetermined number of times. In this embodiment, the number of times for trial is set at 4.

Figures 17, 17A:
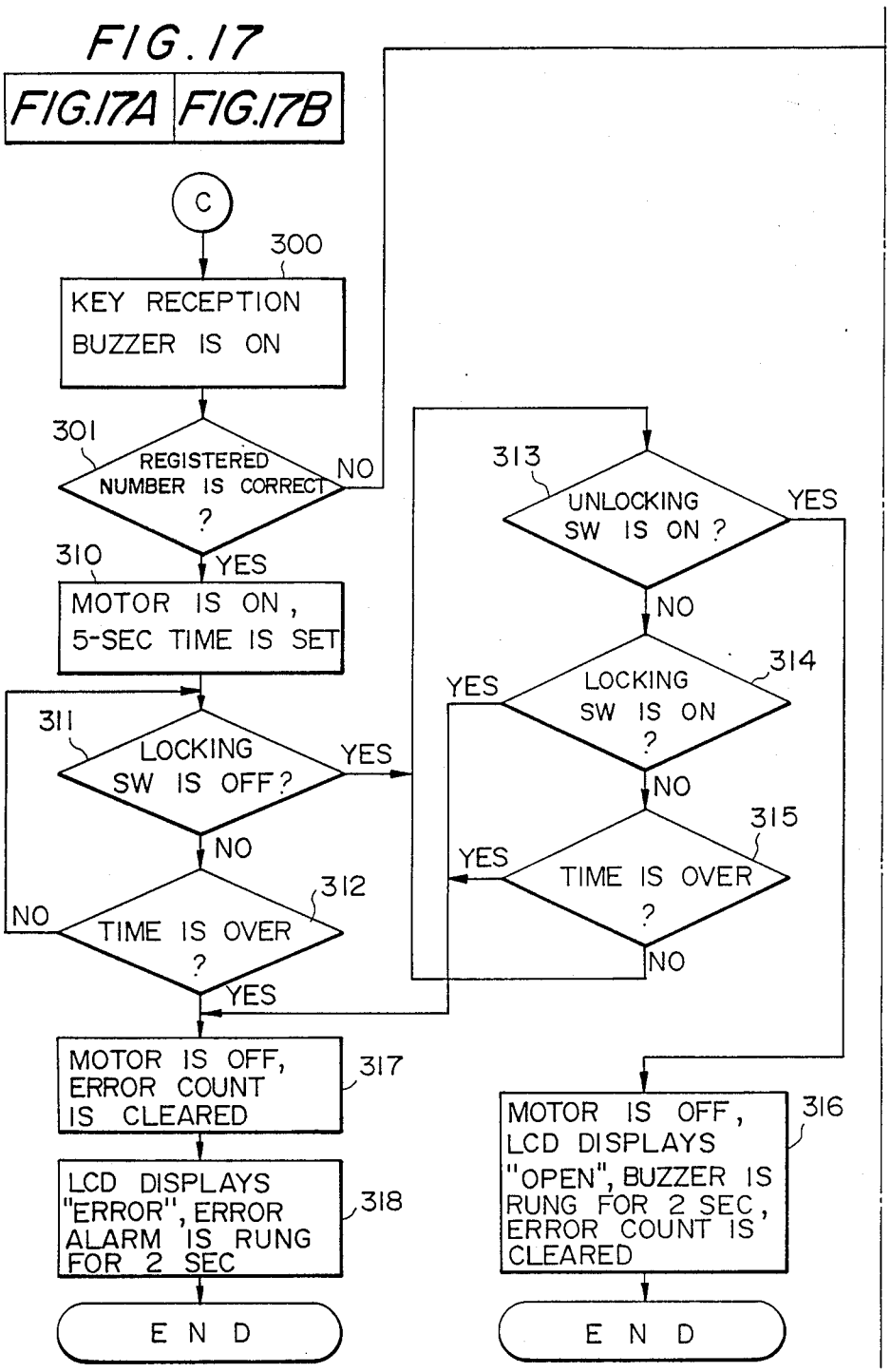
Figure 17B:
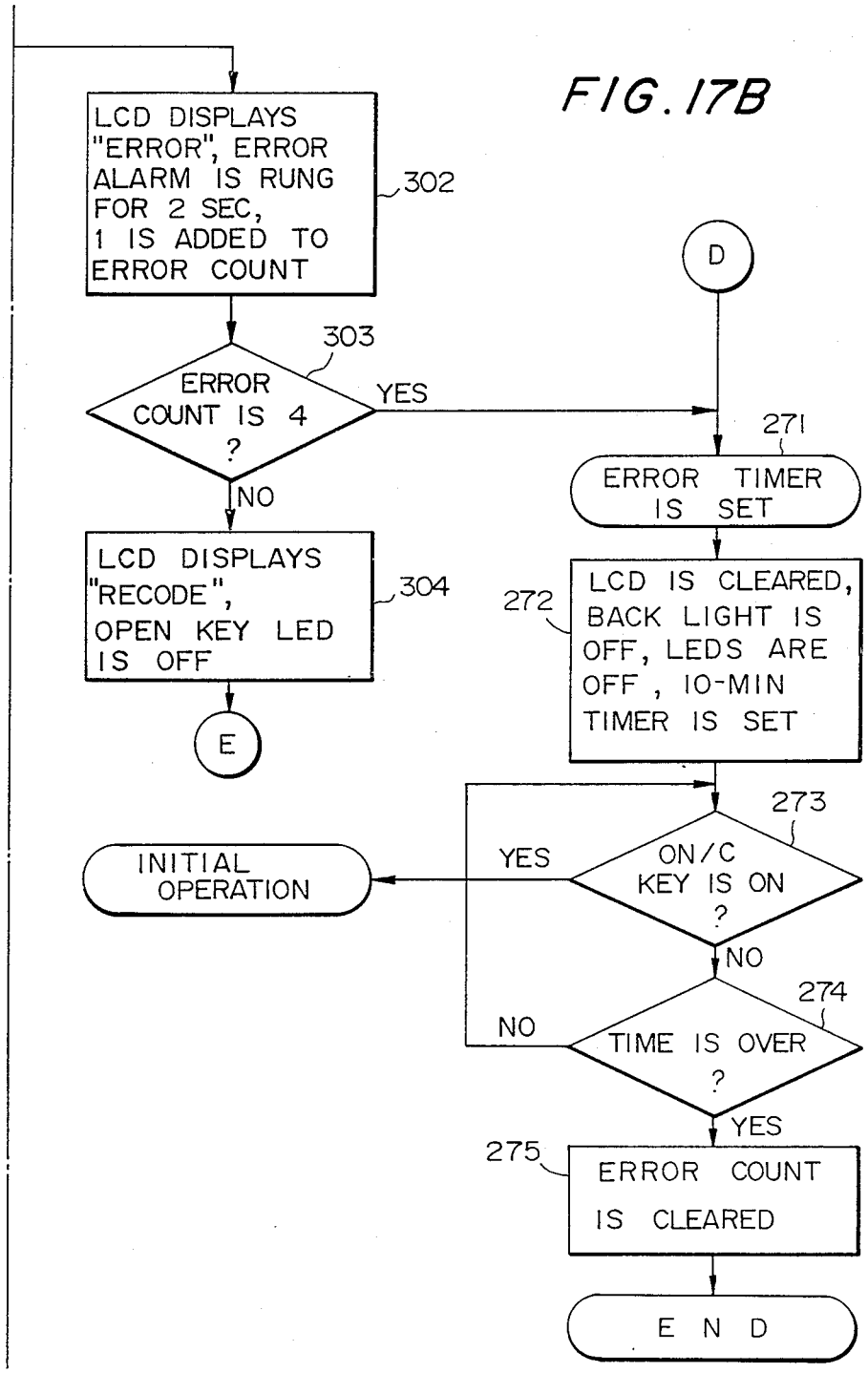

When the error count value is 4, in other words, if the user has made four mistakes in succession in inputting the registered code, the process proceeds from D to the step 271 shown in FIG. 17 and the error timer is set. When a false code is input, the operation for inhibiting the unlocking operation itself for a predetermined time, e.g., 10 minutes in this embodiment is performed. When the error timer is set, the power source of each of the LCD and LED portions is cut off (272). During the operation of the error timer, the operation of the power source clear key 35 is monitored (273), and if the power source clear key 35 is turned on, a series of operation is returned to the initial operation. When the time set on the error timer has elapsed (274), the error count is cleared (275), and the apparatus begins again to receive the registered code and an unlocking signal.

If the error count value is less than a predetermined value at the step 270, a similar control to that for the input of the registered code at the time of locking shown in FIG. 13 is carried out. A series of registered code receiving operation includes the steps 280, 281, 282, 283, 284, 285, 286 and 287, and the registered code of 6 digits is read in the same way as in setting the code.

A predetermined limit time, e.g., 8 seconds is given for inputting each code, and reset in the middle of the operation due to the power source clear key 35 is conducted in the same way as in FIG. 13.

When the registered code for unlocking the safe is input at the step 288, the OPEN key LED 46 is turned on (289), thereby telling the user to push the OPEN key 36. The confirmation of the input key is similar to the confirmation of the CLOSE key 38 at the steps of 230 to 234 in FIG. 13. A series of steps are indicated by 290, 291, 292, 293 and 294 in FIG. 16.

If the OPEN key 36 is correctly operated at the step 291, the key reception buzzer is sounded (300). Whether or not the input code agrees with the registered code is next judged (301), and if the answer in in the negative, "ERROR" is displayed on the LCD 42 and 1 is added to the error count value (302). Judgment is next made as to whether or not the error count is 4 (303), and if it is 4, the process proceeds to the steps of 271 and after, and the controlling operation thereafter is stopped.

If the error count is less than 4, the user is requested to input the registered code again. In this embodiment, "RECODE" is displayed on the LCD 42 and simultaneously the OPEN key LED 46 is turned off (304).

On the other hand, if the registered code is correct at the step (301), the motor 74 is turned on and the timer is set at 5 seconds as the motor operating time (310).

In this state, the lock bar 64 is ordinarily moved from the CLOSE position to the OPEN position against the urging force of the spring 70 by the drive pin 84 of the motor 74. During this operation, the locking switch 86 is switched over from ON to OFF and the unlocking switch 88 is switched over from OFF to ON, these switched states being judged within 5 seconds at the steps 311, 312, 313, 314 and 315. If the unlocking operation is correct, the motor 74 is turned off, "OPEN" is displayed at the LCD 42, buzzer is rung to indicate the completion of the unlocking operation and the error count is cleared at the step 316. Thus, the correct unlocking operation has been completed.

When the switches 86 or 88 does not output the correct detection signal because the motor 74 does not work or for other reasons, the motor is turned off and the error count is cleared at the step 317. At the step 318, "ERROR" is displayed on the LCD 42 and the error alarm is rung for 2 seconds to indicate the user a trouble in the apparatus, thereby finishing a series of operation.

In this way, according to the locking/unlocking operation in this embodiment, even an inexperienced user can proceed the correct operation by the indication on the display. Since an alarm is always given when the user has made a mistake, the correct and secure locking-/unlocking operation is enabled.

As described above, according to the present invention, since the rotational driving force of the drive motor is controlled by unidirectional movement of the lock bar carrying the lock bolt, secure locking/unlocking operation is performed by a simple structure even if the accuracy of the parts or the assembling accuracy is rough.

While there has been described what is at present considered to be a preferred embodiment of the invention, it will be understood that various modifications may be made thereto, and it is intended that the appended claims cover all such modifications as fall within the true spirit and scope of the invention.

What is claimed is:

1. A safe having a motor-driven locking mechanism comprising;

a lock bar which is slidably provided within a door;

a lock bolt which is provided on one end of said lock bar in such a manner as to protrude from said door and effect locking engagement between said door and the safe body;

an urging means for urging said lock bar to the CLOSE position at which said lock bolt protruding from said door is lockable into said safe body;

a driving member which is engageable with a drive arm provided on said lock bar in such a manner that when said driving member is revolved and comes into contact with said drive arm, said driving member engages said drive arm and, against the urging force of said urging means, moves said lock bar to the OPEN position at which said lock bolt is drawn into said door to release said locking engagement between said door and said safe body and, when said driving member reaches the position at which said driving member is released from said drive arm, said driving means restores said lock bar to said CLOSE position by the urging force of said urging means;

a drive motor for revolving said driving member to the position at which said driving member engages said drive arm and to the position at which said driving member is released from said drive arm;

a lock bar detector for detecting said OPEN position and said CLOSE position of said lock bar; and a control circuit for receiving a detection signal of said lock bar detector and a safe open/close command signal supplied from the outside of said safe and supplying the desired drive signal to said drive motor.

2. A safe having a motor-driven locking mechanism according to claim 1, further comprising:

two connection bars which slide in combination with said lock bar; and two lock bolts which are fixed to said connection bars, respectively, and protrude from said door and locking into said safe body when said connection bars slide, said two lock bolts cooperating with said lock bolt provided on said lock bar in said locking engagement between said door and said safe body.

3. A safe having a motor-driven locking mechanism according to claim 2, wherein one end of each of said connection bars is retained by a connection plate which rotates by the movement of said lock bar, thereby sliding said connection bars in combination with said lock bar and effecting said locking engagement between said door and said safe body in three different directions by means of said lock bolt provided on said lock bar and said two lock bolts provided on said connection bars, namely, on the side surface, the upper surface and the lower surface of said door.

4. A safe having a motor-driven locking mechanism according to claim 1, wherein said driving means is composed of a drive pin which is secured to an eccentric cam provided on the output shaft of said drive motor.

5. A safe having a motor-driven locking mechanism according to claim 1, wherein said lock bar detector is a microswitch structure which is turned on and off by a detection cam provided on said lock bar and supplies an output signal to said control circuit, said microswitch structure being composed of a locking switch which is turned on when said lock bar is at said CLOSE position and an unlocking switch which is turned on when said lock bar is at said OPEN position.

6. A safe having a motor-driven locking mechanism according to claim 1, further comprising a keyboard which is disposed on the outer front surface of said door and which is used for inputting a safe open/close command therethrough.

7. A safe having a motor-driven locking mechanism according to claim 1, further comprising a door switch which is provided on said door, which is turned on and off by the door closing and opening operations, respectively, and which supplies a detection signal of the closed or opened state of said door to said control circuit.

8. A safe having a motor-driven locking mechanism according to claim 1, further comprising an emergency device provided on the front side of said door, said emergency device being composed of a removable fixed cover and an unlocking cylinder provided on the inside of said fixed cover and having a key-operated door which can be opened by a predetermined master key, thereby enabling said lock bar to be moved to said OPEN position from the outside of said safe by opening said key-operated door.

* * * * *